United States Patent [19]

Ishii

[11] Patent Number: 4,931,226

[45] Date of Patent: Jun. 5, 1990

[54] CHARGE FORMING APPARATUS

[75] Inventor: Kimio Ishii, Zama, Japan

[73] Assignee: Shinagawa Diecasting Co., Ltd., Japan

[21] Appl. No.: 317,327

[22] Filed: Mar. 1, 1989

[51] Int. Cl.[5] ..... F02M 3/06

[52] U.S. Cl. ..... 261/41.5; 261/57; 261/121.3; 261/35; 261/DIG. 68

[58] Field of Search ..... 261/41.5, 57, 121.3, 261/35, DIG. 68

[56] References Cited

U.S. PATENT DOCUMENTS

| | | | |
|---|---|---|---|
| 2,340,954 | 2/1944 | Garretson . | |
| 3,043,572 | 7/1962 | Ott et al. | 261/41.5 |
| 3,085,791 | 4/1963 | Phillips | 261/DIG. 68 |
| 3,146,844 | 9/1964 | Carlson | 261/41.5 |
| 3,167,599 | 1/1965 | Brown et al. | 261/41.5 |
| 3,252,539 | 5/1966 | Ott et al. | 261/41.5 |
| 3,404,872 | 10/1968 | Nutten | 261/DIG. 68 |
| 3,544,083 | 12/1970 | Currie | 261/41.5 |
| 3,608,874 | 9/1971 | Beckmann | 261/41.5 |
| 3,878,271 | 4/1975 | Garcea | 261/41.5 |
| 3,931,372 | 1/1976 | Pierlot | 261/41.5 |
| 4,283,354 | 8/1981 | Schauer et al. | 261/41.5 |

FOREIGN PATENT DOCUMENTS 43-10402 5/1968 Japan .

*Primary Examiner*—Tim Miles

*Attorney, Agent, or Firm*—Lowe, Price, LeBlanc, Becker & Shur

[57] ABSTRACT

In a charge forming apparatus comprising fuel supply means including an idling orifice and a low speed orifice for feeding the amount of fuel required during the period that an engine is idling or running at a low r.p.m. and a supplemental fuel passage for guiding the fuel to such orifices and an air feeding bypass for keeping the engine idling, the supplemental fuel passage is connected to a portion of the bypass upstream of a manually operable valve for regulating the flow rate of air by means of a connecting path. A negative pressure generated on the engine side rather than on a throttle valve makes negative the supplemental fuel passage and the bypass, but a negative pressure on the upstream side of a valve of the bypass varies in correspondence with the effective path area varied by the valve. Depending upon a difference in negative pressure between the upstream of the valve of the bypass and the supplemental fuel passage, a part of air flows into the supplemental fuel passage, or a part of fuel flows in the bypass, causing the fuel for idling to vary in primary proportion to the amount of air fed through the bypass, thereby keeping the air/fuel rate of a mixture constant all the time.

15 Claims, 2 Drawing Sheets

CHARGE FORMING APPARATUS

BACKGROUND OF THE INVENTION

1. Field of the Invention

The present invention relates to a charge forming apparatus for feeding a fuel/air mixture to an internal combustion engine and, more particularly, to a charge forming apparatus or carburetor including means for feeding the amount of fuel required during the period that the engine is idling or running at a low speed or r.p.m. and means for feeding an amount of air to provide a given r.p.m. to the engine during idling.

2. Description of the Prior Art

As well-known from, e.g., U.S. Pat. Nos. 3,085,791 and 3,404,872 specifications, charge forming apparatus include an idling orifice and a low speed orifice which are open in a mixing passage upstream and downstream of a throttle valve in a closed position and a supplemental fuel passage for guiding fuel to these orifices for the purpose of feeding the amount of fuel required during the period that the engine is idling or running at a low r.p.m.

Most of the charge forming apparatus for feeding a fuel/air mixture to an automotive engine include a bypass open in a mixing passage downstream of a throttle valve to keep the engine running at a low r.p.m. and idling, when loads are generated by, e.g., the operation of an air conditioner during engine idling. This bypass serves to feed air to the engine without being controlled by the throttle valve from any place from an air cleaner to the throttle valve, and is provided with a manually operable valve for the regulation of the flow rate of air.

When said throttle valve is located in the closed position, say, the engine is idling, the fuel is supplied from said idling orifice, and the flow rate of the fuel supplied depends upon how much negative pressure acts on the idling orifice.

Where the engine is used in, e.g., a cold district, on the other hand, it is required to make the r.p.m. of the engine during idling higher than normal. To that end, said manual valve should be operated to sufficiently increase the rate of air flowing through the bypass.

However, when a large amount of air is guided to the downstream side of the throttle valve through the bypass, it is impossible to increase the rate of fuel supplied from the idling orifice in correspondence to said large amount of air by reason of its limited diameter, resultling in the mixture becoming so lean that the r.p.m. of the engine drops.

SUMMARY OF THE INVNETION

The present invention has for its object to solve the aforesaid drawbacks of the prior art.

According to the present invention, this object is achieved by the provision of a charge forming apparatus or carburetor including an idling orifice and a low speed orifice open in a mixing passage downstream and upstream of a throttle valve in a closed position, a supplemental fuel passage for guiding fuel to said orifices, an air-feeding bypass open in said mixing passage downstream of said throttle valve, and a manually operable valve for varying the effective area of said bypass to regulate the rate of air, in which the rate of air flowing through said bypass is regulated by said manual valve, whereby the air/fuel ratio of an air/fuel mixture is kept constant so that an idling of the engine is kept stable all the time, even when the r.p.m. of the engine during idling is set at any desired value.

BRIEF DESCRIPTION OF THE DRAWINGS

Other objects and advantages of the present invention will become apparent from a reading of the following detailed explanation with reference to the accompanying drawings, which are given for the purpose of illustration alone, and in which.

DETAILED DESCRIPTION OF THE PREFERRED EMBODIMENTS

Figure 1:
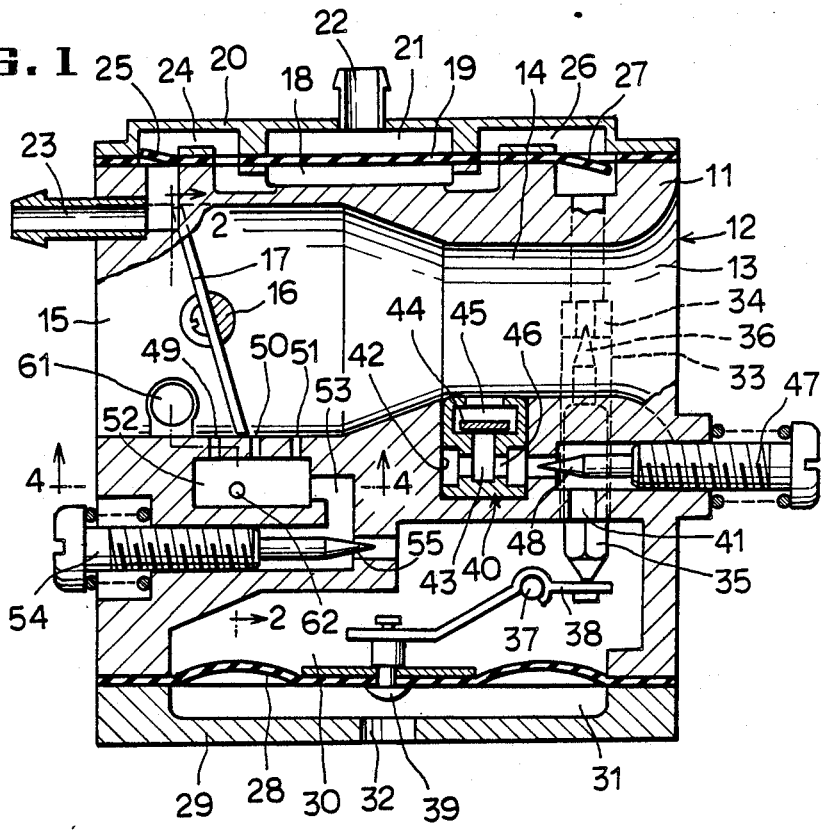
FIG. 1 is a view of one embodiment of the charge forming apparatus or carburetor according to the present invention, which is sectioned along the central line of the mixing passage.

In FIGS. 1 to 4, there is shown one preferred embodiment of the diaphragm type charge forming apparatus or carburetor for feeding an air/fuel mixture to a two cycle internal combusition engine.

The charge forming apparatus or carburetor shown in FIGS. 1 to 4 comprises a body 11 in which formed is a mixing passage 12 including an air inlet region 13, a venturi 14 and a mixture outlet region 15. Rotatably supported on the body 11 is a shaft 16 which supports a disc-like throttle valve 17 perpendicularly across the mixture outlet region 15. The valve 17 serves to control the amount of a fuel/air mixture fed to the engine.

Referring to FIG. 1, a recess is provided in one surface of the body 11 parallel with the mixing passage 12, and is covered with a flexible diaphragm 19 to define a pump chamber 18. On the diaphragm 19, there is a cover member 20, which is fixed to the body 11 by means of a screw, not shown. A recess in the cover member 20 defines a pulse chamber 21, and an opening 22 to be connected to a crank case of the two-cycle internal combustion engine is provided in the cover member 20.

With a pressure change in said crank case introduced in said pulse chamber 21, said diaphragm 19 is moved to increase or decrease the volume of said pump chamber 18. The fuel stored in a fuel tank, not shown, is admitted from a nipple 23 to the pump chamber 18 through an inlet passage 24 formed continuously through the body 11 and the cover member 20, and is then fed toward an outlet passage 26 formed continuously through the body 11 and the cover member 20. As well-known in the art, this pumping action takes place through the movement of said diaphragm 19. In order to prevent the backflow of fuel, said inlet and outlet passages 24 and 26 are respectively provided with inlet and outlet check valves 25 and 27, which are formed by providing a cutout in a part of said diaphragm 10 in a cantilever manner, as well-known in the art.

On the side opposite to said pump means, there is disposed fuel control means with the mixing passage 12 interposed therebetween. The fuel control means includes a flexible diaphragm 28 covering a recess formed in one plane of the body 11 parallel with the mixing passage 12 and a cover member 20 located thereon, and a fuel chamber 30 is defined by a space limited by said recess and diaphragm 28. A space limited by said diaphragm 28 and cover member 29 also defines an air chamber 31 which the atmosphere enters or leaves freely through an opening 32 formed in the cover member 29.

Said outlet passage 26 is connected together with a valve seat 34 to an upper end of an guide bore 33 extending upwardly of the fuel chamber 30. An upper-end needle portion 36 of a valve body 35 inserted into the guide bore 33 cooperates with the valve seat 34 to control the fuel fed through the outlet passage 26 to the fuel chamber 30.

Within said fuel chamber 30, there is disposed a lever 38 supported by a pin 37 attached to the body 11, with its longer end portion being joined to a rivet 39 formed at the center of the diaphragm 28 and its shorter end portion to a lower end of the valve body 35.

As the amount of fuel remaining on the diaphragm 28 reduces, the diaphragm 28 moves upwardly to rotate the lever 38 in the lockwise direction in FIG. 1, thereby enlarging a gap between the valve seat 34 and the needle portion 36. Hence, there is an increase in the amount of fuel fed through the outlet passage 26 to the fuel chamber 30. As the amount of fuel staying on the diaphragm 28 increases, the diaphragm 28 moves downwardly to rotate the lever 38 in the counterclockwise direction, thereby making narrower the gap between the valve seat 34 and the needle portion 36. Such movements permit fuel to be store all time in nearly constant amount in the fuel chamber 30.

Referring to FIG. 1, one means for feeding the fuel from the fuel chamber 30 to the mixing passage 12 includes a main orifice assembly 40 placed toward the smallest portion of the diameter of the venturi 14 and a main fuel passage 41 for guiding the fuel from the fuel chamber 30 to the main orifice assembly 40.

The main orifice assembly 40 is fitted into a recess 42 in the body 11, and includes a main orifice 43 for feeding the fuel to the venturi 14, a counter bore 45 in which accommodated is a disc valve 44 disposed at an outlet of the main orifice 43, and an opening 46 for feeding the fuel flowing through the main fuel passage 41 to the main orifice 43.

The main fuel passage 41 is formed within the body 11, and an extreme needle valve 48 of an adjust screw 47 screwed into the body 11 serves to determine the maximum flow rate of fuel flowing through the main fuel passage 41.

As the throttle valve 17 is about to open more widely than when the engine is idling or running at a low r.p.m., the air flows through a throttled portion of the venturi 14 at a speed so high that a high negative pressure is generated within the main orifice assembly 40 to to space the disc valve 44 away from the outlet of the main orifice 43. The fuel in the fuel chamber 30 is supplied to the mixing passage 12 by way of the main fuel passage 41, opening 46, main orifice 42 and counter bore 45.

Referrig to FIGS. 1 to 4, another means for feeding the fuel from within the fuel chamber 30 to the mixing passage 12 includes one idling orifice 49 open in the mixture outlet region 15 downstream of the throttle valve 17 placed in a closed position, two low speed orifices 50 and 51 open in the mixture outlet region upstream of the throttle valve 17, one chamber 52 for distributing the fuel to the orifices 49, 50 and 51, and a supplemental fuel passage 53 for guiding the fuel from within the fuel chamber 30 to the chamber 52.

The supplemental fuel passage 53 is formed within the body 11, and an extreme needle valve 55 of an adjust screw 54 screwed into the body 11 serves to determine the maximum flow rate of fuel flowing through said supplemental fuel passage 53.

When the engine is idling, the mixing passage 12 is closed up by the throttle valve 17, so that the fuel is supplied from the idling orifice 49 to the mixing passage 12 by a higher negative pressure on the engine side rather than on the throttle valve 17. When the engine is running at a low r.p.m., the mixing passage 12 is made open slightly by the throttle valve 15 so that an additional amount of fuel is supplied to the mixing passage 12 from the low speed orifices 50 and 51 by a higher negative pressure acting thereon.

Figure 2:
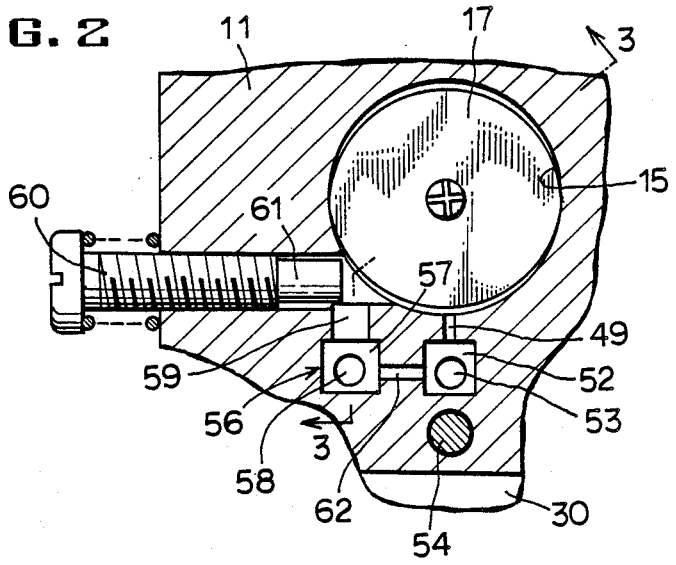
FIG. 2 is a sectional view taken along the line 2—2 of FIG. 1.
Figure 3:
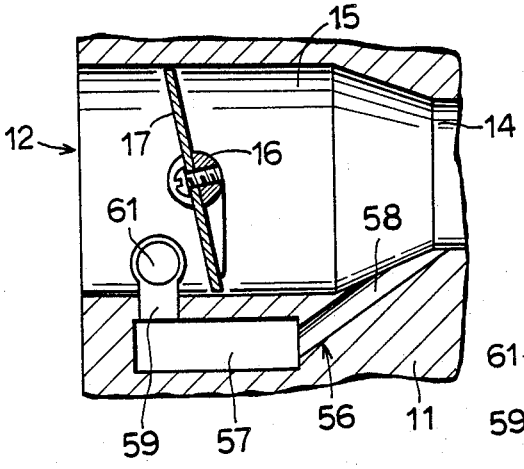
FIG. 3 is a sectional view taken along the line 3—3 of FIG. 2.
Figure 4:
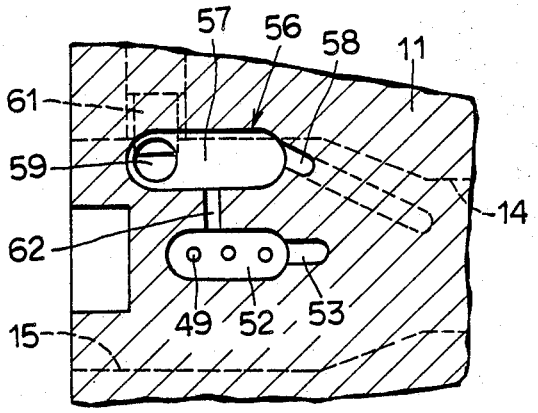
FIG. 4 is a sectional view taken along the line 4—4 of FIG. 1.

Means for making it possible to feed a sufficient amount of air to the engine regardless of the mixing passage 12 being closed up by the throttole valve 17 includes a bypass 56 connecting at its both ends with the mixing passage 12 upstream and downstream of the throttle valve 17. Referring to FIGS. 2 to 4, the bypass 56 includes a supplemental air chamber 57 disposed sideways of said chamber 52 for passing the supplemental fuel through, an upper course 58 which is open in the mixing passage 12 in a skirt portion extending downstream of the throttled portion of the venturi 14 and connects with supplemental air chamber 57, and a lower course 59 which is open in the mixing passage 12 downstream of the throttle valve 17 and connectes with the sumpplemental air chamber 57.

The bypass 56 is formed within the body 11, and an extreme columnar valve 61 at the extreme end of an adjust screw 60 screwed into the body 11 juts toward a 90° bend of the lower course 59 to vary the effective path area in a stepless manner for the regulation of the amount of air.

When a chain saw or mower with a built-in two-cycle internal combusion engine is resisted by trees or grass at idling of the engine, the engine is likely to run at a more reduced r.p.m. or even stop due to loads imposed thereon. In such cases, said bypass 56 operates to feed an additional amount of air to the engine for keeping the engine running at the given r.p.m., thus avoiding such engine troubles as r.p.m. reductions or engine halting.

Referring to FIGS. 2 and 4, said chamber 52 and supplemental air chamber 57 are interconnected together by a connecting path 62 having an reduced path area.

Reference will now be made to a first mode of operation where the columnar valve 61 is moved forward by manual screwing of the adjust screw 60 to regulate down to an extremely small amount of air fed to the engine through the bypass 56. When the engine is idling, a negative pressure generated on the engine side rather than on the throttle valve 15 makes said two chambers 52 and 57 negative. However, since the columnar valve 61 then allows the lower course 59 to be opened to only slight a degree, a higher negative pressure is generated in the chamber 52 than in the supplemental air chamber 57. For that reason, the air in the supplemental air chamber 57 flows through a connecting path 62 to the chamber 52 wherein it is mixed with the fuel to supply a fuel/air mixture from the idling orifice 49 to the mixing passage 12. In consequence, if the amount of air fed to the engine through the bypass 56 is small, the amount of fuel supplied from the idling orifice 49 to the mixing passage 12 is small.

In a second mode of operation where the columnar valve 61 is retracted from said position by turning of the adjust screw 60 to make the amount of air fed to the engine through the bypass 56 larger than that mentioned above, the difference in the negative pressures between said two chambers 52 and 57 is smaller than that mentioned above. For that reason, the amount of air flowing from the supplemental air chamber 57 to the chamber 52 is so reduced that the amount of fuel fed from the idling orifice 49 to mixing passage 12 is larger than that mentioned above.

In such cases, the air flowing into the chamber 52 through the connecting path 62 acts as bleed air with respect to the fuel fed from the idling orifice 49 to the mixing passage 12.

With the columnar valve 61 retracted further than retracted in the second position, there is a position at which the negative pressure in the chamber 52 is equal to that in the supplemental air chamber 57. This third mode of operation is identical with the conventional mode wherein the connecting path 62 is not included.

In a fourth mode of operation where the columnar valve 61 is retracted still further than retracted in the third position, a higher negative pressure is generated in the supplemental air chamber 57 than in the chamber 52. This causes a part of the fuel in the chamber 52 to flow into the supplemental air chamber 57, from where it is fed to the mixing passage 12 together with a large amount of air passing through the wide-open lower course 59. At that time, an additional amount of fuel is also fed from the idling orifice 49 to the mixing passage 12.

With the foregoing explanation in mind, it is to be understood that the negative pressure upstream of the columnar valve 61 of the bypath 56 varies in correspondence to the position of the columnar valve 61, i.e., the effective path area, and the fuel for idling varies in primary proportion to the air flowing through the bypath 56 in correspondence with a difference between said negative pressure and the negative pressure prevailing in the supplemental fuel passage 53.

Figure 5:
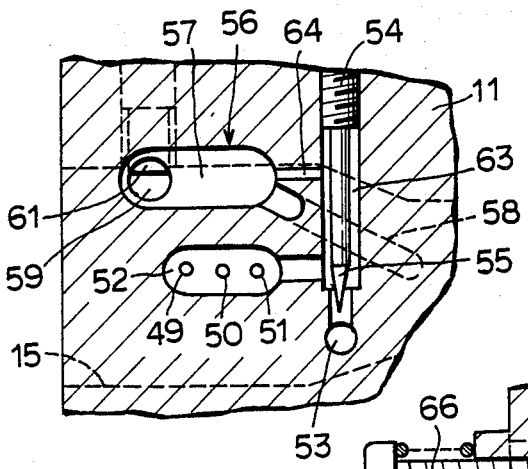
FIG. 5 is a sectional view, similar to FIG. 4, for illustrating another embodiment of the present invention.

FIG. 5 illustrates another embodiment of the present invention. According to this embodiment, the needle valve 55 extending from the adjust screw 54 toward the supplemental fuel passage 53 is inserted into a guide hole 63, which is connected to the air chamber 57 by way of a connecting path 64.

Figure 6:
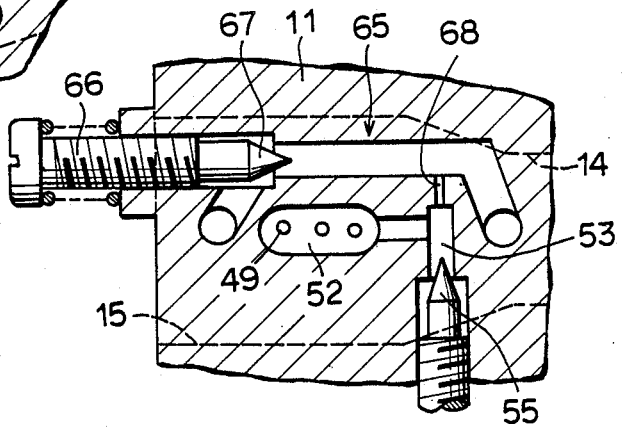
FIG. 6 is a sectional view, similar to FIG. 4, for illustrating a further embodiment of the present invention.

FIG. 6 illustrates a further embodiment of the present invention, according to which a bypass 65 does not include a supplemental air chamber and an extreme needle valve 67 of an adjust screw 66 screwed into the body 11 varies the effective path area of the bypass 65 in a stepless manner. A place between the needle valve 55 of the supplemental fuel passage 53 and the chamber 52 is connected to a place upstream of the bypass 65 by way of a connecting path 68.

What is claimed is:

1. A charge forming apparatus comprising:

a main fuel passage for feeding essentially liquid fuel from a fuel chamber to a main orifice located in a venturi portion of a mixing passage, said venturi portion being upstream of a throttle valve;

a supplemental fuel passage for supplying essentially liquid fuel from said fuel chamber to a fuel distribution chamber;

an idling orifice and a pair of low speed orifices in fluid communication between said fuel distribution chamber and said mixing passage, said idling orifice being downstream of said throttle valve and said pair of low speed orifices being upstream of said throttle valve when said throttle valve is in a closed position;

an air bypass passage in fluid communication at one end thereof with said mixing passage at a skirt portion thereof upstream of said throttle valve and in fluid communication at another end thereof with said mixing passage downstream of said throttle valve;

a manually operable valve disposed in said air bypass passage near said another end thereof for regulating the flow of air passing through said bypass passage in a stepless manner; and a connecting passage for providing fluid communication between said supplemental fuel passage and said air bypass passage upstream of said manually operable valve.

2. A charge forming apparatus according to claim 1, further including a valve member disposed in said supplemental fuel passage for controlling the liquid fuel flow between said fuel chamber and said fuel distribution chamber.

3. A charge forming apparatus according to claim 1, wherein said connecting passage has a valve means disposed therein for controlling the liquid fuel flow between said fuel chamber and said fuel distribution chamber and between said fuel chamber and said connecting passage.

4. A charge forming apparatus according to claim 1, wherein said connecting passage is in fluid communication with said supplemental fuel passage upstream of said fuel distribution chamber.

5. A charge forming apparatus according to claim 1, wherein said air bypass passage includes a supplemental air chamber upstream of said manually operable valve.

6. A charge forming apparatus according to claim 5, wherein said connecting passage is located in direct contact between said supplemental air chamber and said fuel distribution chamber.

7. A charge forming apparatus according to claim 6, wherein said supplemental air chamber and said fuel distribution chamber are parallel to each other.

8. A diaphragm type charge forming apparatus comprising:

a pump chamber formed on one side of said apparatus for supplying fuel to a fuel chamber.

a main fuel passage for feeding essentially liquid fuel from said fuel chamber to a main orifice located in a venturi portion of a mixing passage, said venturi portion being upstream of a throttle valve;

a supplemental fuel passage for supplying essentially liquid fuel from said fuel chamber to a fuel distribution chamber;

an idling orifice and at least one low speed orifice in fluid communication between said fuel distribution chamber and said mixing passage, said idling orifice being downstream of said throttle valve and said at least one low speed orifice being upstream of said throttle valve;

an air bypass passage in fluid communication at one end thereof with said mixing passage at a skirt portion thereof upstream of said throttle valve and in fluid communication at another end thereof with said mixing passage downstream of said throttle valve;

a manually operable valve disposed in said air bypass passage near said another end thereof for regulating the flow of air passing through said bypass passage in a stepless manner; and a connecting passage for providing fluid communication between said supplemental fuel passage and said air bypass passage upstream of said manually operable valve.

9. A diaphragm type charge forming apparatus according to claim 8, further including a valve member disposed in said supplemental fuel passage for controlling the fuel flow between said fuel chamber and said fuel distribution chamber.

10. A diaphragm type charge forming apparatus according to claim 8, wherein said connecting passage has a valve means disposed therein for controlling the fuel flow between said fuel chamber and said fuel distribution chamber and between said fuel chamber and said connecting passage.

11. A diaphragm type charge forming apparatus according to claim 8, wherein said connecting passage is in fluid communication with said supplemental fuel passage upstream of said fuel distribution chamber.

12. A diaphragm type charge forming apparatus according to claim 8, wherein one wall of said fuel chamber comprises a flexible diaphragm.

13. A diaphragm type charge forming apparatus according to claim 8, wherein said air bypass passage includes a supplemental air chamber upstream of said manually operable valve.

14. A diaphragm type charge forming apparatus according to claim 13, wherein said connecting passage is located in direct contact between said supplemental air chamber and said fuel distribution chamber.

15. A diaphragm type charge forming apparatus according to claim 14, wherein said supplemental air chamber and said fuel distribution chamber are parallel to each other aligned.

* * * * *